US009316982B2

(12) United States Patent
Yoda et al.

(10) Patent No.: US 9,316,982 B2
(45) Date of Patent: Apr. 19, 2016

(54) FIXING DEVICE, IMAGE FORMING APPARATUS

(71) Applicant: KYOCERA Document Solutions Inc., Osaka-shi, Osaka (JP)

(72) Inventors: Junya Yoda, Osaka (JP); Yoshiyuki Odaka, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/435,724

(22) PCT Filed: Apr. 9, 2014

(86) PCT No.: PCT/JP2014/060256

§ 371 (c)(1),
(2) Date: Apr. 14, 2015

(87) PCT Pub. No.: WO2014/175067

PCT Pub. Date: Oct. 30, 2014

(65) Prior Publication Data

US 2015/0234334 A1 Aug. 20, 2015

(30) Foreign Application Priority Data

Apr. 24, 2013 (JP) ..... 2013-091773

(51) Int. Cl.
*G03G 15/20* (2006.01)
*G03G 15/00* (2006.01)

(52) U.S. Cl.
CPC ..... *G03G 15/5004* (2013.01); *G03G 15/205* (2013.01); *G03G 15/2017* (2013.01); *G03G 15/2039* (2013.01); *G03G 15/2078* (2013.01)

(58) Field of Classification Search
CPC ..... G03G 15/205; G03G 15/5004; G03G 15/2078; G03G 15/2039; G03G 15/2017
See application file for complete search history.

(56) References Cited

U.S. PATENT DOCUMENTS

2007/0059017 A1* 3/2007 Omura ..... G03G 15/5004 399/88
2010/0290796 A1 11/2010 Sato
2012/0107005 A1* 5/2012 Hase ..... G03G 15/5004 399/70
2013/0209115 A1* 8/2013 Hase ..... G03G 15/205 399/33

FOREIGN PATENT DOCUMENTS

JP 04352185 A 12/1992
JP 2007003564 A 1/2007
JP 2010266694 A 11/2010

OTHER PUBLICATIONS

ISA Japanese Patent Office, Written Opinion of the International Searching Authority Issued in International Patent Application No. PCT/JP2014/060256, Jul. 15, 2014, WIPO, 6 pages.

* cited by examiner

*Primary Examiner* — David Gray
*Assistant Examiner* — Michael Harrison
(74) *Attorney, Agent, or Firm* — Alleman Hall McCoy Russell & Tuttle LLP

(57) ABSTRACT

A fixing device is provided with a magnetic flux generating unit, first and second rotary bodies, a fixing belt, a temperature sensing portion, a stopped time measuring portion, an abnormality determination portion, and a heating delay portion. The fixing belt extends between the first and second rotary bodies, and is heated by the first rotary body. The temperature sensing portion is disposed downstream of the first rotary body and senses the temperature of the fixing belt. The stopped time measuring portion measures a time period after heating has been stopped before an instruction to start heating is inputted. The abnormality determination portion determines any abnormality in the fixing belt based on a change in temperature after heating has started. When a stopped time is shorter than a pre-configured time period, the heating delay portion delays the start time via magnetic flux based on the instruction to start heating.

4 Claims, 7 Drawing Sheets

FIXING DEVICE, IMAGE FORMING APPARATUS

TECHNICAL FIELD

The present invention relates to an image forming apparatus and a fixing device including a fixing belt extended on and between a first rotary body to which heat is to be applied and a second rotary body that is to be rotationally driven.

BACKGROUND ART

An image forming apparatus using an electrophotographic method includes a fixing device for fixing on a print sheet a toner image transferred to the print sheet. The fixing device includes a heating roller (first rotary body), a fixing roller (second rotary body), a fixing belt extended on and between each of the rollers, a pressure roller, and a heating unit for heating the heating roller to indirectly heat the fixing belt. When a print sheet is conveyed to a nip portion formed between the fixing roller and the pressure roller, a toner image on the print sheet is pressed by the fixing roller and the pressure roller, and additionally heated by the fixing belt. As a result, the toner image is fixed onto the print sheet.

In this type of fixing devices, sometimes the fixing belt slips with respect to the fixing roller etc., and temporarily stops, resulting in a part of the fixing belt in contact with the heating roller to reach an extremely high temperature. As a measure against such a problem, a heating unit of Patent Literature 1 measures surface temperatures of a fixing roller before and after a predetermined time period using a temperature sensor, calculates a slope of temperature difference (temperature gradient) from the measured two temperatures, and determines the fixing belt to be in an abnormal state when the change ratio is larger than a predetermined value.

CITATION LIST

Patent Literature

[PTL 1] Japanese Laid-Open Patent Publication No. 2010-266694

SUMMARY OF THE INVENTION

Problems to be Solved by the Invention

However, in the fixing device having the fixing belt, sometimes the fixing belt partially slips to rotate in a biased manner or deviates sideways with respect to the fixing roller and the heating roller. In such cases, the fixing belt is put and brought near one side of the heating roller in the long side direction, and sometimes the fixing belt is lifted upward from an end part of the heating roller or torn due to making contact with other members. When a temperature sensor is disposed at an upward-lifted part or a torn part of the fixing belt, the temperature measured by the temperature sensor does not increase readily, and a control portion continues applying heat even when the temperature of other parts of the fixing belt has increased to an intended temperature. As a result, the heating roller is heated to an abnormal level. Such abnormal heating is not preferable since the abnormal heating may ignite a print sheet stuck in the fixing device or may melt other members in the apparatus.

The present invention has been made in view of the above described situation, and an object of the present invention is to provide an image forming apparatus and a fixing device capable of preventing excessive heating of a heating roller caused by abnormalities such as tearing and upward-lifting of a fixing belt.

Solution to the Problems

A fixing device according to one aspect of the present invention includes a magnetic flux generating unit, a first rotary body, a second rotary body, a fixing belt, a temperature sensing portion, a stopped time measuring portion, an abnormality determination portion, and a heating delay portion. The first rotary body is configured to generate heat through action of magnetic flux generated by the magnetic flux generating unit. The second rotary body is disposed parallel with respect to the first rotary body. The fixing belt is extended on and between the first rotary body and the second rotary body, and is to be heated by the first rotary body. The temperature sensing portion is disposed on an upstream side from the second rotary body in a rotation direction of the fixing belt, but on a downstream side from the first rotary body in the rotation direction of the fixing belt. The temperature sensing portion is capable of sensing temperature of the fixing belt. The stopped time measuring portion is configured to measure a time period during which heating has been stopped before a heating-start instruction for heating the fixing belt is inputted to the magnetic flux generating unit. The abnormality determination portion is configured to determine, after heating of the fixing belt is started, abnormality of the fixing belt based on a change rate over time of temperature sensed using the temperature sensing portion. The heating delay portion is configured to, under a condition that the stopped time measured by the stopped time measuring portion is shorter than a configured time period determined in advance, delay, for a predetermined time period, a timing at which heating of the fixing belt is to be started through generation of magnetic flux by the magnetic flux generating unit based on the heating-start instruction.

Furthermore, an image forming apparatus according to another aspect of the present invention includes the fixing device.

Advantageous Effects of the Invention

With the present invention, it is possible to prevent excessive heating of a heating roller caused by abnormalities such as tearing and upward-lifting of a fixing belt.

DESCRIPTION OF EMBODIMENTS

In the following, embodiments of the present invention will be described with reference to the drawings as appropriate. It should be noted that each of the following embodiments is merely one example realizing the present invention, and does not limit the technological scope of the present invention in any way.

[Image Forming Apparatus 10]

Figure 1:
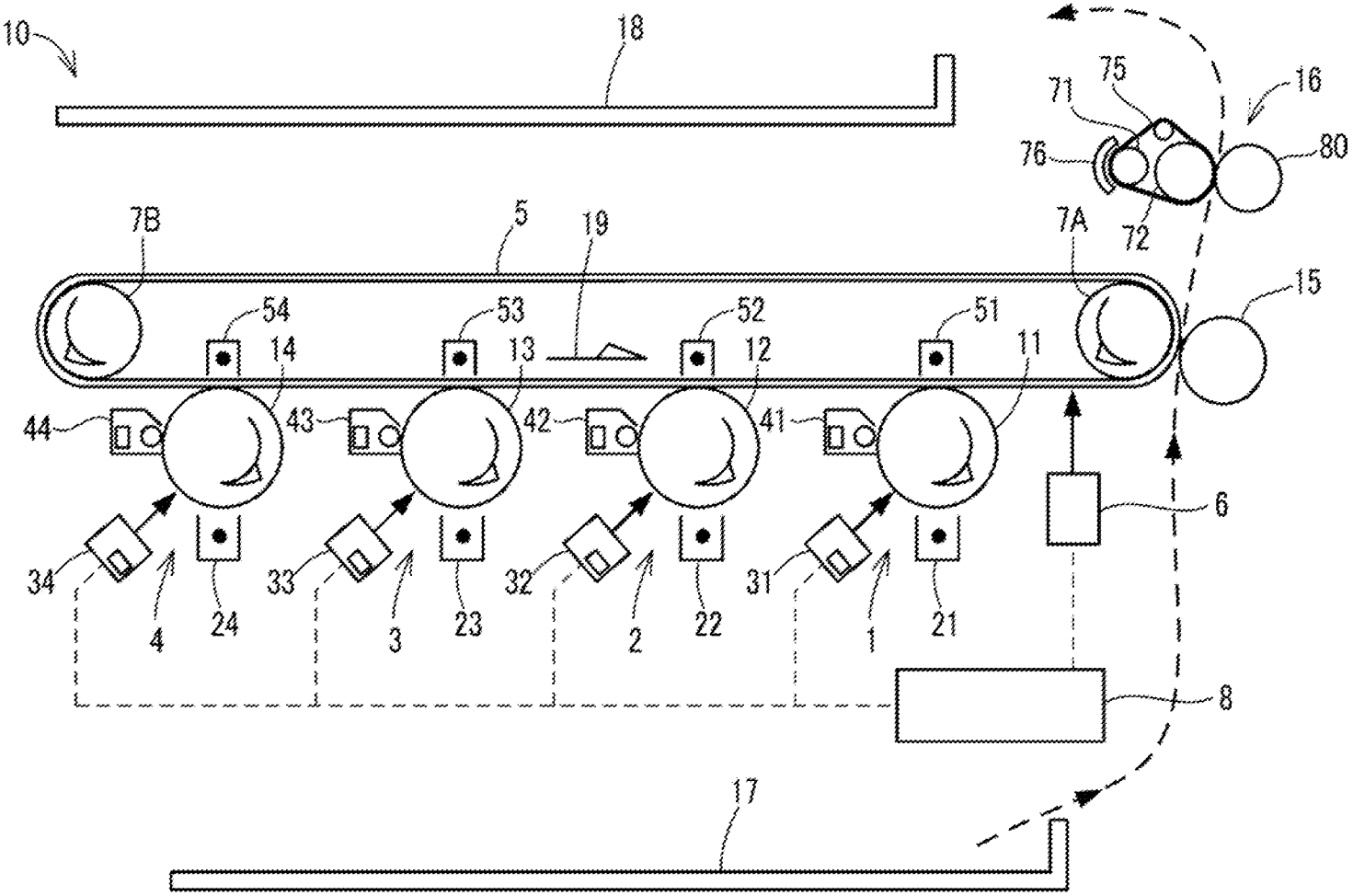
FIG. 1 shows a configuration of an image forming apparatus according to an embodiment of the present invention.

FIG. 1 shows a configuration of an image forming apparatus 10 (one example of an image forming apparatus of the present invention) according to an embodiment of the present invention. As shown in FIG. 1, the image forming apparatus 10 is a color image forming apparatus of a so-called tandem type, and includes a plurality of image forming portions 1 to 4, an intermediate transfer belt 5, a registration detection sensor 6, a drive roller 7A, a driven roller 7B, a secondary transfer device 15, a fixing device 16 (one example of a fixing device of the present invention), a control portion 8, a paper feed tray 17, and a paper output tray 18. Specific examples of the image forming apparatus 10 according to the embodiment of the present invention include printers, copy machines, facsimiles, and multifunctional peripherals having functions of those. Furthermore, the image forming apparatus 10 is not limited to the color image forming apparatus and may be a monochrome image forming apparatus.

The image forming portions 1 to 4 are electrophotographic type image forming portions configured to form toner images having different colors respectively on a plurality of photoconductor drums 11 to 14 arranged on respective sides, and successively overlay and transfer the toner images onto the intermediate transfer belt 5 that is running (in motion). In the example shown in FIG. 1, the image forming portion 1 for black, the image forming portion 2 for yellow, the image forming portion 3 for cyan, and the image forming portion 4 for magenta are arranged in a single line in this order from the downstream side of the moving direction (direction of an arrow 19) of the intermediate transfer belt 5.

The image forming portions 1 to 4 respectively include: the photoconductor drums 11 to 14 each configured to support a toner image; charging devices 21 to 24 configured to charge the respective surfaces of the photoconductor drums 11 to 14; exposure devices 31 to 34 configured to form electrostatic latent images by exposing and scanning light on the respective surfaces of the charged photoconductor drums 11 to 14; developing devices 41 to 44 configured to develop the electrostatic latent images on the respective photoconductor drums 11 to 14 using toners; primary transfer devices 51 to 54 configured to transfer the toner images on the respective photoconductor drums 11 to 14 to the intermediate transfer belt 5; and the like. Although not shown in FIG. 1, the image forming portions 1 to 4 each include a cleaning device for removing residual toner images on the respective photoconductor drums 11 to 14.

The intermediate transfer belt 5 is an endless circular belt formed from a material such as, for example, rubber and urethane. The intermediate transfer belt 5 is supported on the drive roller 7A and the driven roller 7B in a rotationally drivable manner. The drive roller 7A is disposed at a position (right side in FIG. 1) close to the fixing device 16, and the driven roller 7B is disposed at a position (left side in FIG. 1) distant from the fixing device 16. The surface of the drive roller 7A is formed from a material such as, for example, rubber or urethane in order to increase the frictional force with respect to the intermediate transfer belt 5. Since the intermediate transfer belt 5 is supported by the drive roller 7A and the driven roller 7B, the surface of the intermediate transfer belt 5 can move while being in contact with each of the surfaces of the photoconductor drums 11 to 14. When the surface of the intermediate transfer belt 5 passes through the photoconductor drums 11 to 14 and the primary transfer devices 51 to 54, toner images are sequentially overlaid and transferred to the intermediate transfer belt 5 from the photoconductor drums 11 to 14.

The secondary transfer device 15 transfers the toner image transferred on the intermediate transfer belt 5 onto a print sheet conveyed from the paper feed tray 17. The print sheet having transferred thereon the toner image is conveyed to the fixing device 16 by a conveying portion which is not shown.

[Fixing Device 16]

Figure 2A:
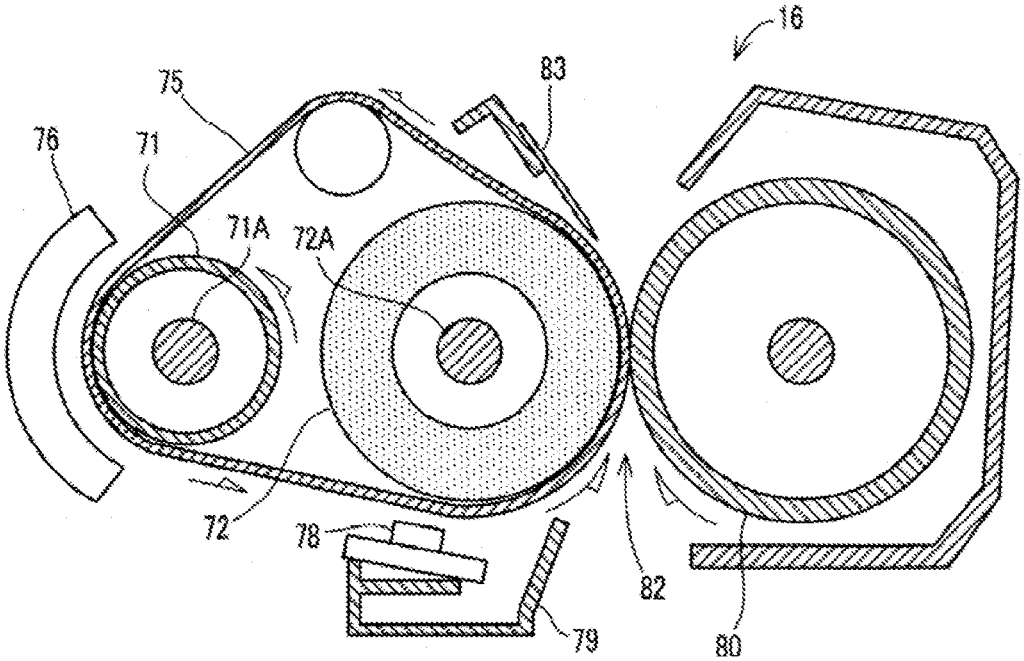
FIG. 2A shows a configuration of a fixing device according to the embodiment of the present invention.
Figure 2B:
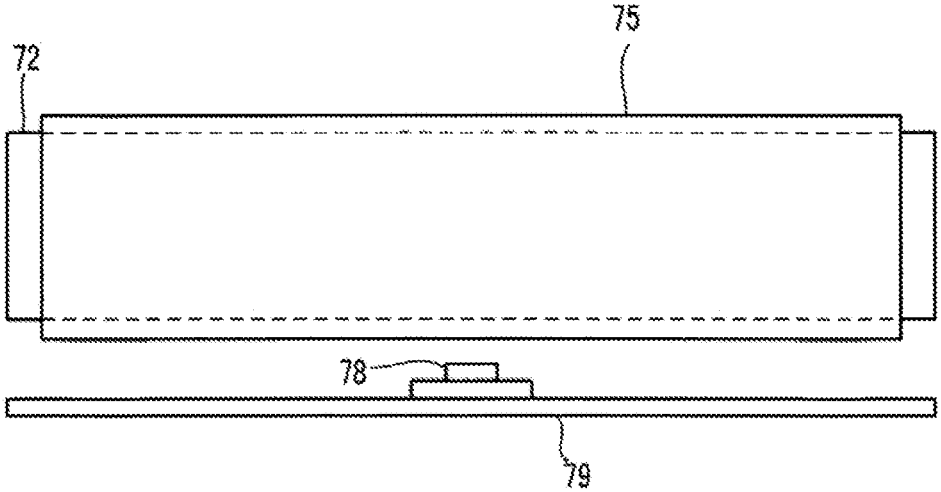
FIG. 2B shows the position where a temperature sensor is arranged in the fixing device shown in FIG. 2A.

As shown in FIG. 2A and FIG. 2B, the fixing device 16 includes a heating roller 71, a fixing roller 72, a fixing belt 75, an induction-heating unit 76, a temperature sensor 78, and a pressure roller 80. Here, FIG. 2A shows a configuration of the fixing device 16, and FIG. 2B shows the position where the temperature sensor 78 is arranged in the fixing device 16.

The heating roller 71 is configured to generate heat through induction heating using magnetic flux from the induction-heating unit 76. The heating roller 71 is one example of a first rotary body of the present invention. The heating roller 71 is formed from a high magnetic body such as, for example, a product made from steel. The heating roller 71 has a support shaft 71A at the center, and the support shaft 71A is rotatably supported by a frame of the fixing device 16 etc. With this, the heating roller 71 is rotatable.

The fixing roller 72 is disposed so as to be parallel with respect to the heating roller 71. The fixing roller 72 is disposed at a position separated from the heating roller 71 by a predetermined interval. The fixing roller 72 is one example of a second rotary body of the present invention. The fixing roller 72 has a support shaft 72A at the center, and the support shaft 72A is rotatably supported by the frame of the fixing device 16 etc. With this, the fixing roller 72 is rotatable. The fixing roller 72 is coupled to a motor 67 which is drive-controlled by a motor driver 66 of the control portion 8 via a drive transmission mechanism which is not shown. When the motor 67 is rotationally driven, its rotational driving force is transmitted to the fixing roller 72, and the fixing roller 72 rotates in a predetermined direction. In the present embodiment, the fixing roller 72 is rotationally driven in a counterclockwise direction in FIG. 2A. The outer circumferential surface of the fixing roller 72 is covered with an elastic member having elasticity such as silicone and porous rubbers.

The fixing belt 75 is extended on and between the heating roller 71 and the fixing roller 72. The fixing belt 75 is one example of a fixing belt of the present invention. The fixing belt 75 is an endless form belt that is rotated when being driven by a rotational drive of the fixing roller 72. Since the fixing belt 75 is extended on the heating roller 71 etc., heat from the heating roller 71 generated through induction heating by magnetic flux from the induction-heating unit 76 is transferred to the fixing belt 75. Thus, the fixing belt 75 is heated by the heating roller 71.

The induction-heating unit 76 is a device that causes an object to generate heat by induction-heating method using electromagnetic induction, and is one example of a magnetic flux generating unit of the present invention. The induction-heating unit 76 is disposed so as to cover the circumferential surface of the heating roller 71 via a gap. The outer circumferential surface of the heating roller 71 is heated from one direction thereof by heat generated through induction heating by magnetic flux from the induction-heating unit 76.

The temperature sensor 78 is disposed in the periphery of the fixing belt 75. The temperature sensor 78 is one example of a temperature sensing portion of the present invention. The temperature sensor 78 is disposed on a frame 79 of the fixing device 16 disposed below the fixing roller 72. The temperature sensor 78 is disposed on an upstream side from the fixing roller 72 in a rotation direction of the fixing belt 75, but on a downstream side from the heating roller 71 in the rotation direction of the fixing belt 75. The temperature sensor 78 is disposed adjacent to the fixing belt 75. In the present embodiment, as shown in FIG. 2B, the temperature sensor 78 is disposed at a position facing the central part of the fixing roller 72 in the long side direction thereof, and senses the temperature of the central part of the fixing roller 72.

The pressure roller 80 is disposed opposingly to the fixing roller 72. The pressure roller 80 is pressed against the fixing roller 72 by a spring or the like. With this, a nip portion 82 is formed between the pressure roller 80 and the fixing roller 72.

In the fixing device 16, a print sheet is conveyed so as to slip through the nip portion 82 from down to up in FIG. 1. A separation blade 83 is disposed on the downstream side from the nip portion 82 in the conveying direction of a paper sheet. In order to prevent a print sheet from sticking to the fixing belt 75, the print sheet is peeled off from the fixing belt 75 by the separation blade 83 at a timing when the print sheet slips through the nip portion 82.

Figure 3A:
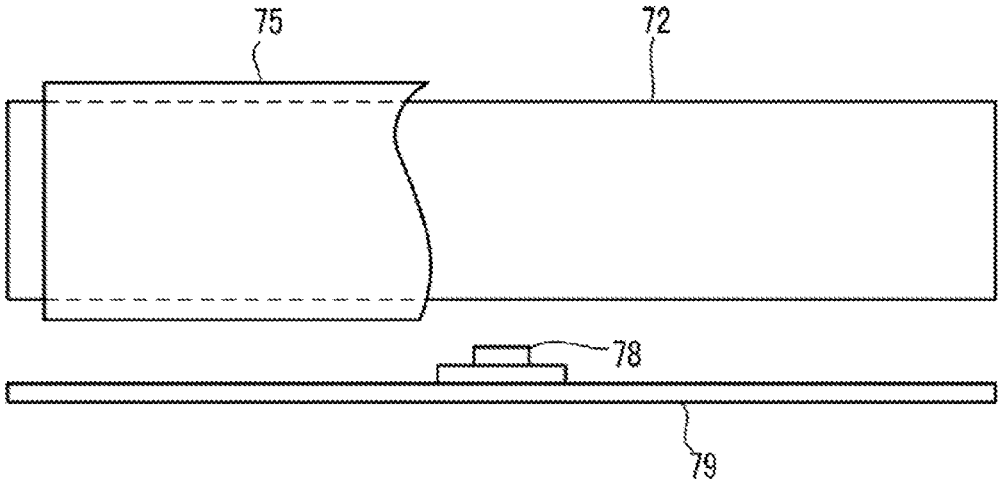
FIG. 3A shows an abnormal state of a fixing belt in the fixing device shown in FIG. 2A.
Figure 3B:
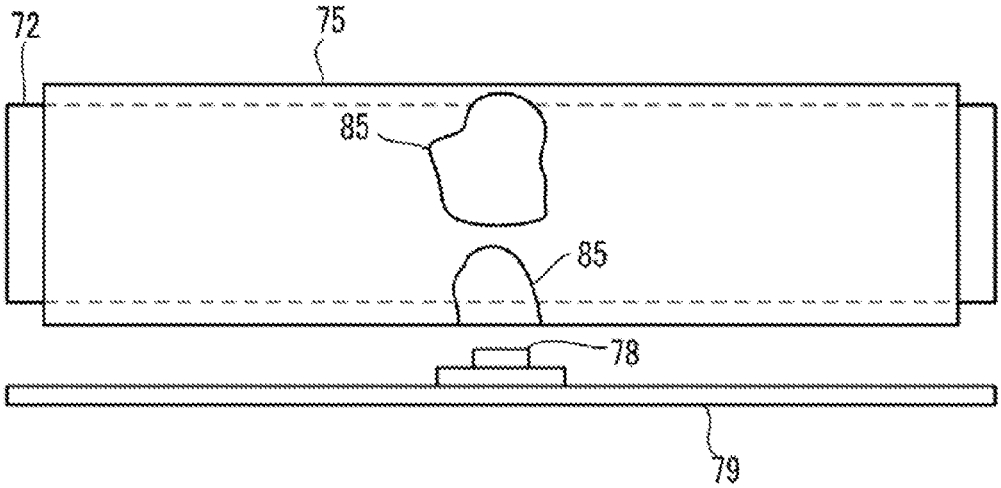
FIG. 3B shows an abnormal state of the fixing belt in the fixing device shown in FIG. 2A.

In the fixing device 16 formed as described above, when the fixing belt 75 deviates sideways or rotates in a biased manner, the fixing belt 75 is put and brought near the left end as shown in FIG. 3A, and is lifted upward from an end part of the heating roller 71 or the fixing roller 72, or torn due to making contact with other members. In addition, as shown in FIG. 3B, when a worker removes a print sheet stuck in the nip portion 82, the worker may sometimes damage the fixing belt 75 and create a hole 85. In such a case, the temperature of the surface of the fixing belt 75 cannot be sensed using the temperature sensor 78, but instead the temperature of the surface of the fixing roller 72 is sensed. Since heat is not transferred to a part where the fixing belt 75 does not exist, the temperature sensed by the temperature sensor 78 will constantly indicate a low temperature and the control portion 8 continues heating the heating roller 71. As a result, the heating roller 71 reaches an excessively high temperature, and may ignite a print sheet or melt other members in the apparatus. In order to deal with such a situation, a later-described abnormality determination process is executed by the control portion 8 in the present embodiment.

[Control Portion 8]

Figure 4:
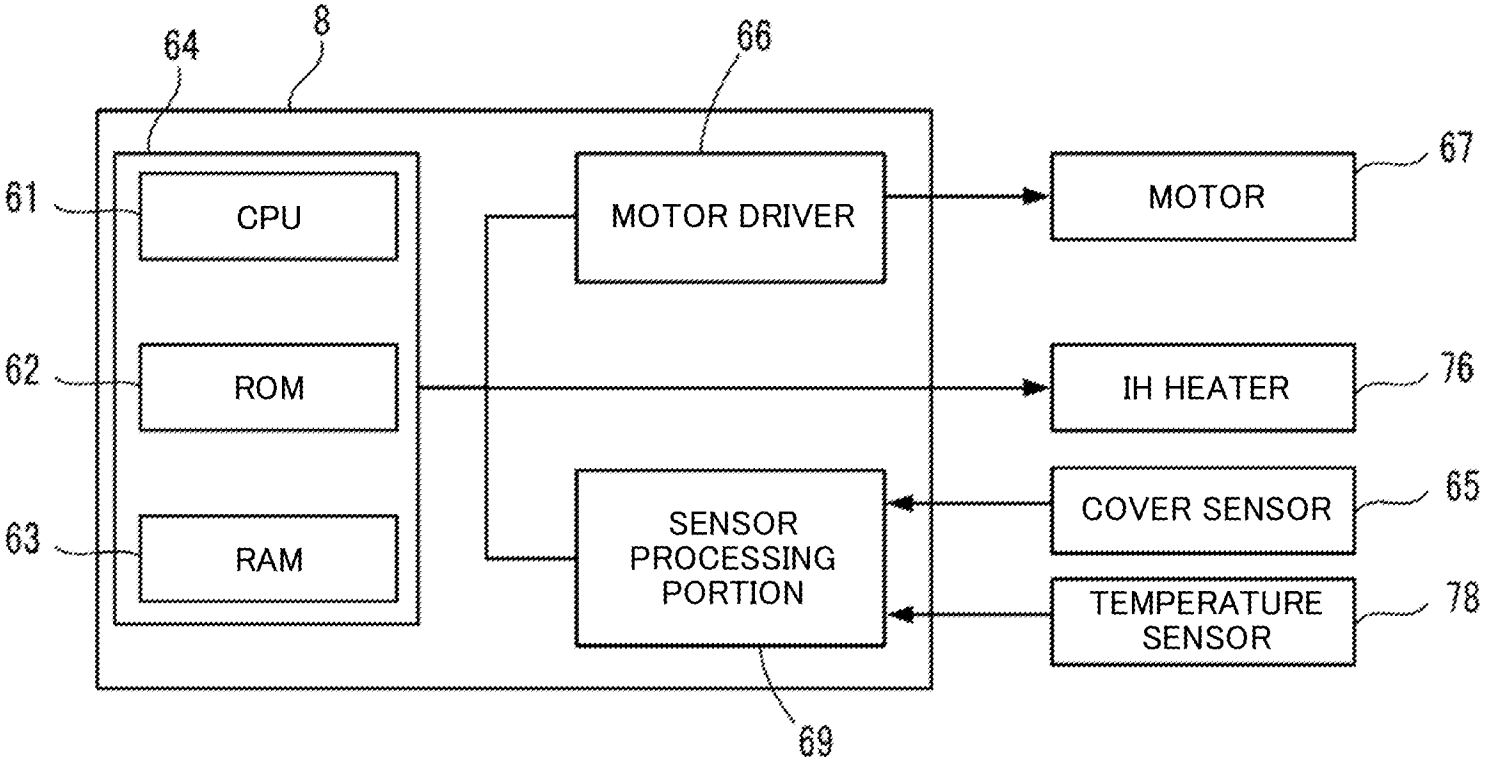
FIG. 4 is a block diagram showing a configuration of a control portion included in the image forming apparatus shown in FIG. 1.

The control portion 8 controls the image forming apparatus 10 in a collective manner, and, as shown in FIG. 4, includes a calculation portion 64 including a CPU 61, a ROM 62, and a RAM 63, the motor driver 66, and a sensor processing portion etc. In the calculation portion 64, the later-described abnormality determination process and the like are executed by the CPU 61 in accordance with a predetermined program stored in the ROM 62. It should be noted that a stopped time measuring portion, an abnormality determination portion, a heating delay portion, a first stop control portion, and a second stop control portion of the present invention are achieved by the control portion 8 and the calculation portion 64.

In the present embodiment, thresholds used in the later-described abnormality determination process are stored in the RAM 63. Specific thresholds stored therein include a threshold (configured time period: 10 [s]) used in a determination process at step S15 and a threshold (configured temperature: 100° C.) used in a determination process at step S17 described later. In addition, also stored in the RAM 63 is a time period (heating-stopped time T) during which a heating-stopped state has continued before an instruction to warm up described later is inputted. The heating-stopped time is obtained by having the CPU 61 measure a stopped time using, for example, an internal counter or a software counter in the heating-stopped state, and ending the measuring of the stopped time at a timing when the instruction to warm up is inputted. The heating-stopped time is then stored in the RAM 63. It should be noted that the abnormality determination process is not limited to that obtained through execution of a program by the CPU 61, and may be achieved, for example, by an electronic circuit such as an integrated circuit (ASIC).

The calculation portion 64 is electrically connected to the induction-heating unit 76, and heating of the heating roller 71 using the induction-heating unit 76 is controlled by the calculation portion 64. When a target temperature is, for example, 175° C.; the calculation portion 64 causes the induction-heating unit 76 to generate magnetic flux such that the surface temperature of the fixing belt 75 reaches the target temperature of 175° C.

The motor driver 66 and the sensor processing portion 69 are formed by, for example, internal memory, electronic circuits such as an integrated circuit (ASIC), and the like. The motor driver 66 is electrically connected to the motor 67. The motor driver 66 controls the rotation of the drive roller 7A and the rotation of the fixing roller 72 through drive-control of the motor 67 based on instruction signals from the calculation portion 64. The sensor processing portion 69 is electrically connected to a cover sensor 65 and the temperature sensor 78. Here, the cover sensor 65 is, for example, a sensor for sensing an open/closed state of a cover that is opened and closed when removing a print sheet stuck in the fixing device 16. The cover is disposed on a housing of the image forming apparatus 10. When the cover is opened, the calculation portion 64 stops the temperature control of the heating roller 71 using the induction-heating unit 76 in order to protect a worker, and when the cover is closed, the calculation portion 64 restarts the temperature control of the heating roller 71 using the induction-heating unit 76. Opening of the cover by the worker is one example of a condition for stopping the fixing device 16 based on an external factor.

The sensor processing portion 69 converts an output signal inputted from the temperature sensor 78 into a digital signal. The calculation portion 64 obtains a temperature sensed by the temperature sensor 78 based on the signal converted by the sensor processing portion 69. It should be noted that the motor driver 66 and the sensor processing portion 69 are not limited to those formed by electronic circuits such as an integrated circuit (ASIC), and may be achieved for example through execution of a predetermined program by the CPU 61.

[Abnormality Determination Process]

Figure 5:
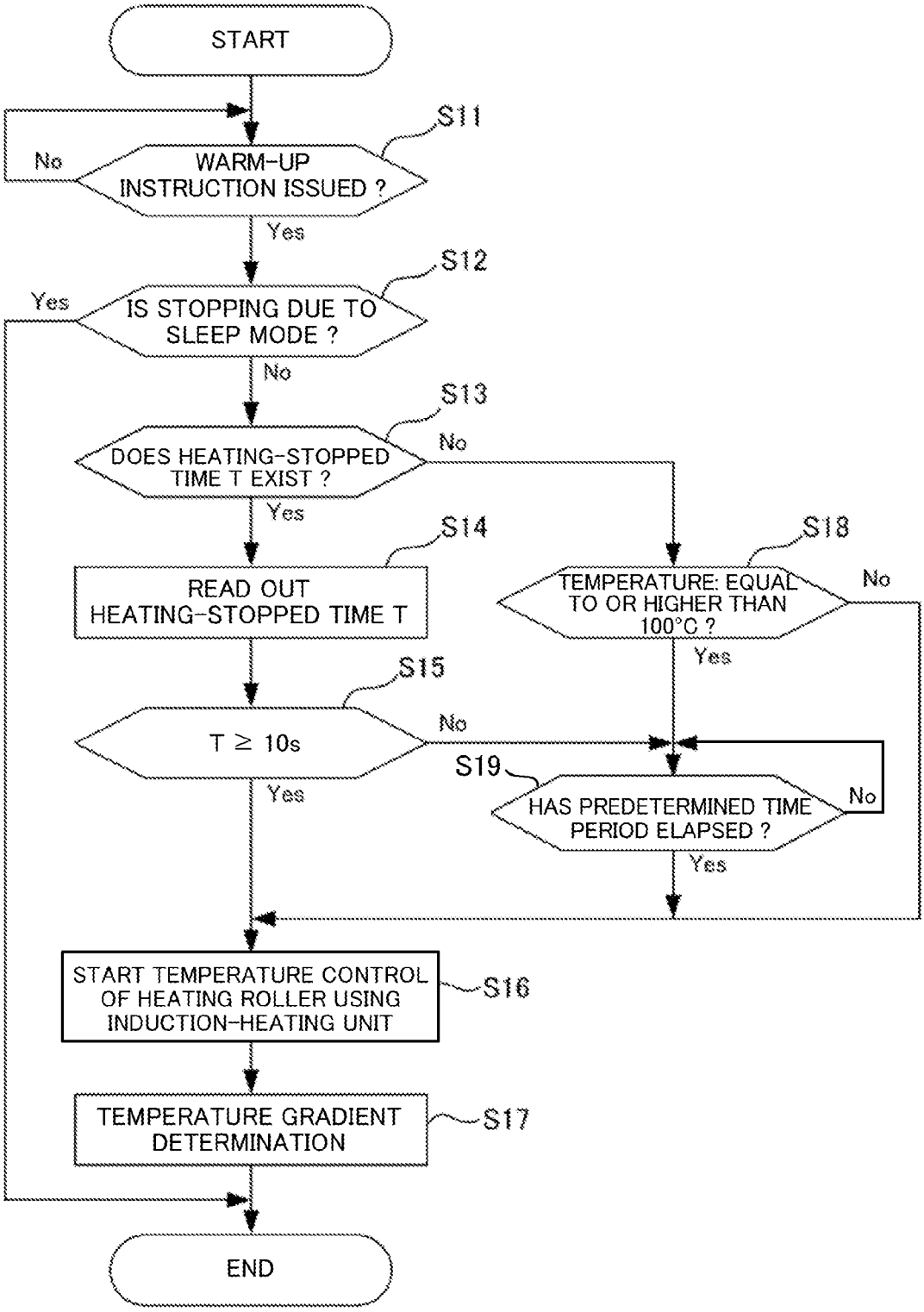
FIG. 5 is a flowchart showing steps of an abnormality determination process executed by the control portion shown in FIG. 4.

Next, with reference to the flowchart in FIG. 5 and the graphs in FIGS. 6 to 8, one example of the procedure of the abnormality determination process executed by the control portion 8 will be described. In the figures, S11, S12, . . . each represents the number of a processing procedure (step). A process in each of the steps is performed by the control portion 8, in more detail, is performed by having the CPU 61 of the calculation portion 64 execute a program stored in the ROM 62. In the following description, the time point at step S11 is a state where temperature control of the heating roller 71 using the induction-heating unit 76 is stopped.

Figure 6:
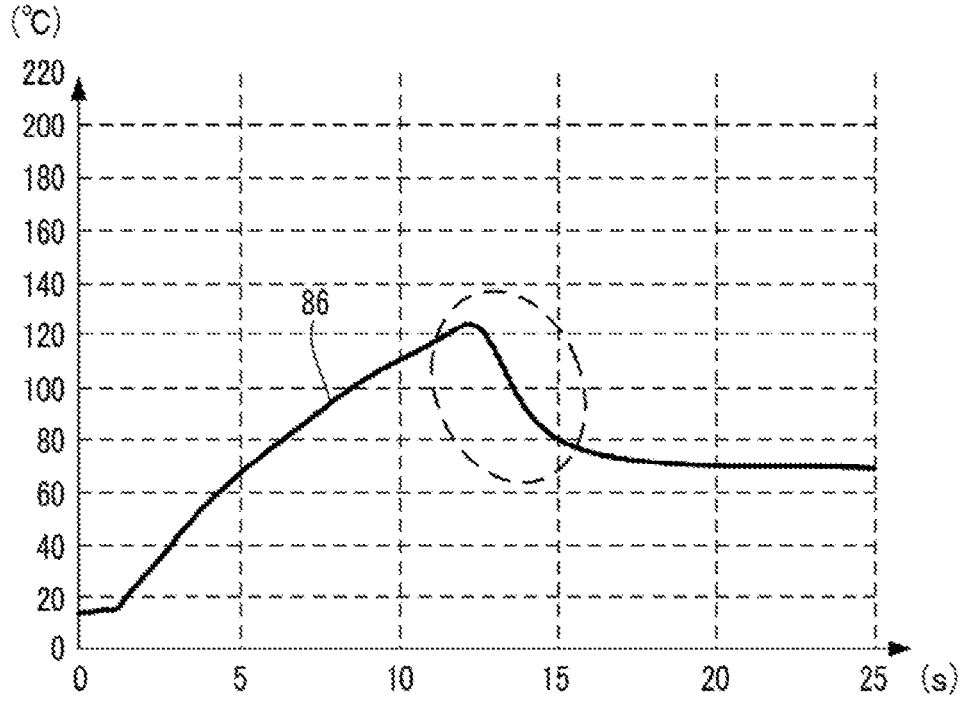
FIG. 6 shows a temperature change when an abnormality occurs in the fixing belt during a temperature control of a heating roller.
Figure 7:
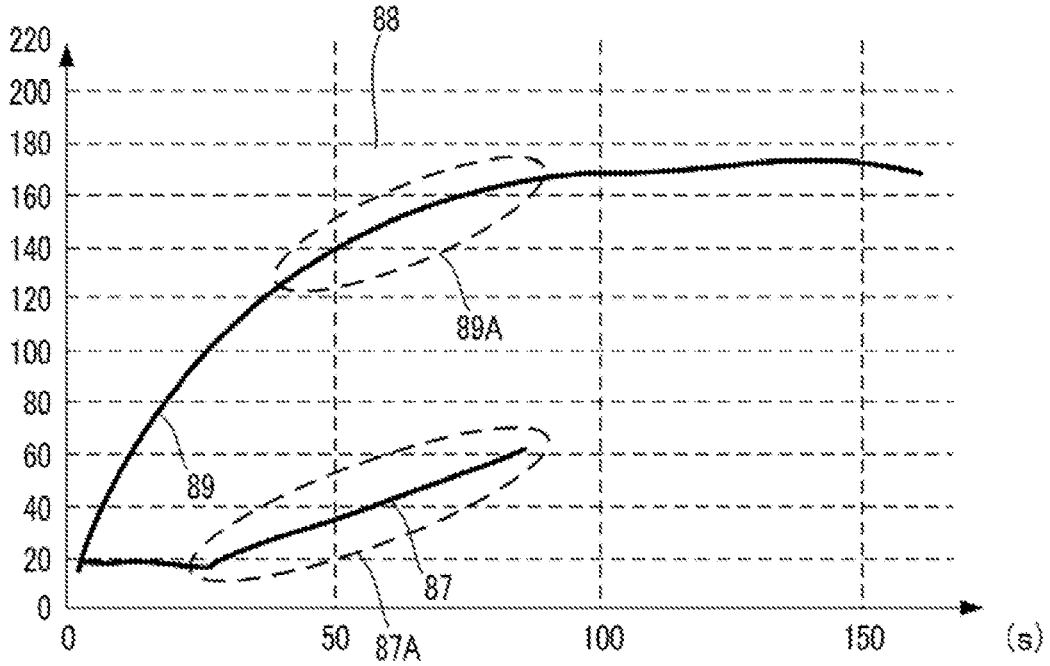
FIG. 7 shows an abnormal temperature change and a normal temperature change in accordance with the peripheral environment.
Figure 8:
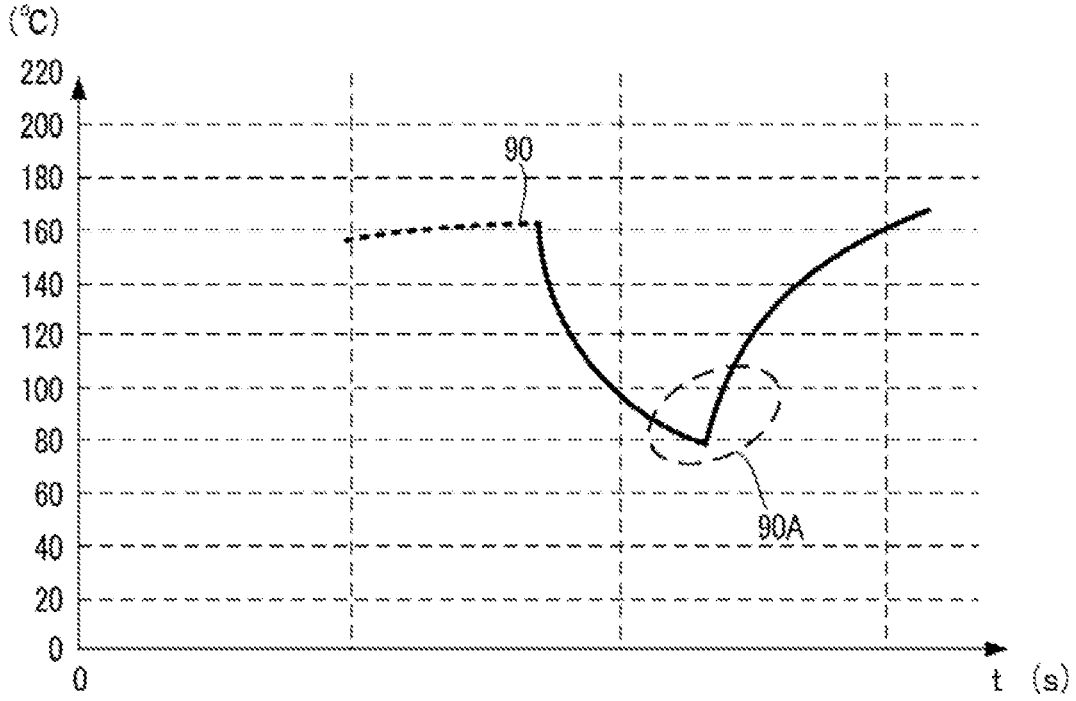
FIG. 8 shows a temperature change when the temperature control of the heating roller is delayed.

First, with reference to FIGS. 6 and 7, description will be provided regarding a change in temperature sensed by the temperature sensor 78 when the fixing belt 75 is heated using the induction-heating unit 76. Here, FIG. 6 shows a temperature change 86 in a case where an abnormality occurs in the fixing belt 75 while the temperature of the fixing belt 75 is rapidly rising because of temperature control of the heating roller 71 using the induction-heating unit 76, and a malfunction occurs in the sensing of temperature by the temperature sensor 78. When an abnormality occurs in the fixing belt 75 while the temperature of the fixing belt 75 is rapidly rising because of temperature control of the heating roller 71 using the induction-heating unit 76, the temperature sensor 78 becomes unable to sense temperature of the fixing belt 75. At this moment, the temperature sensed using the temperature sensor 78 rapidly decreases, and the temperature change rate changes greatly (cf. enclosed part indicated by a dashed line in FIG. 6). Since the gradient (temperature change rate) during the decrease in temperature is clearly different from the gradient (temperature change rate) during the increase in temperature, whether there is an abnormality in the fixing belt 75 can be easily determined from the temperature change rate over a short period of time of the temperature sensed by the temperature sensor 78.

Furthermore, FIG. 7 shows: a temperature change 87 of the temperature sensed by the temperature sensor 78 when, for example, an abnormality has occurred in the fixing belt 75 from the time when power has been turned on and temperature sensing using the temperature sensor 78 has malfunctioned at an ordinary temperature; a normal temperature change 88 when a rated voltage is supplied to the image forming apparatus 10 under an ordinary temperature environment; and a normal temperature change 89 when a low voltage is supplied under a low temperature environment. According to the temperature change 87 in FIG. 7, even when the temperature control of the heating roller 71 is conducted using the induction-heating unit 76 from a low-temperature state, if an abnormality occurs in the fixing belt 75, the temperature sensed by the temperature sensor 78 gradually increases since the temperature is only affected by the increase in the peripheral temperature (cf. enclosure line 87A). Since the temperature of the fixing belt 75 should increase rapidly as shown in the temperature changes 88 and 89 if the fixing belt 75 is normal, an abnormality of the fixing belt 75 can be detected even with a gradual gradient (temperature change rate) as in the temperature change 87. However, there are cases where the image forming apparatus 10 is used in an environment with voltage lower than the rated voltage, and, for example, when the image forming apparatus is operated with a low voltage, although a sudden change is observed at the beginning as in the case in the temperature change 89, the temperature changes generally with the same gradient as in the case in the temperature change 87 in a high temperature range (140° C. to 175° C.) around the enclosure line 89A. Thus, even when an abnormality occurs in the fixing belt 75 at a point in the enclosure line 89A of the temperature change 89, the abnormality in the fixing belt 75 cannot be determined since the temperature change rate of the temperature sensed by the temperature sensor 78 is not different from that in a normal case. However, in the present embodiment, even with such a temperature change, the abnormality in the fixing belt 75 can be easily determined from the temperature change rate over a short period of time by conducting the abnormality determination process by the control portion 8.

First, at step S11, the control portion 8 determines whether an instruction to warm up has been inputted, in other words, whether an instruction to start heating the fixing belt 75 has been inputted. The "warm up" is to heat the fixing belt 75 using the induction-heating unit 76 by passing current through the induction-heating unit 76. Here, specific examples of conceivable warm-up instructions include: a print instruction inputted when the image forming apparatus 10 is in a sleep mode (power saving mode); an instruction issued when the cover that has been opened for maintenance or for dealing with jamming is closed; and an instruction issued when a main power supply of the image forming apparatus 10 has been turned on. It should be noted that the sleep mode is an operation mode in which the amount of power consumption is reduced in the fixing device 16 and the image forming apparatus 10 by at least stopping the heating of the fixing belt 75 using the induction-heating unit 76.

When the instruction to warm up is inputted, the control portion 8 determines whether the state of the image forming apparatus 10 before the input of the warm-up instruction is the sleep mode (S12). For example, when an operation log of the image forming apparatus 10 is stored, the determination is made by referring to the operation log. Alternatively, when bit information indicating the status is stored, the determination is made by referring to the bit information. At step S12, when the image forming apparatus 10 is determined to be in the sleep mode, the abnormality determination process ends without conducting the processes subsequent to step S12. More specifically, when heating of the heating roller 71 using the induction-heating unit 76 is stopped because of having the operation mode switched to the sleep mode, even if the warm-up instruction is inputted after the stop, the control portion 8 does not conduct delaying for a predetermined time period in the following steps S14 to S18. The sleep mode is an operation mode to which the image forming apparatus 10 is automatically switched when operations for forming images have not been conducted for a certain period of time, and, by the nature of the sleep mode, the possibility of an abnormality occurring in the fixing belt 75 in the sleep mode is extremely low. Thus, the waste of time in executing the processes subsequent to step S12 is resolved, and processing load is reduced.

At step S12, when the state of the image forming apparatus 10 is determined as not to be in the sleep mode, the control portion 8 conducts the processes subsequent to step S13 sequentially, and conducts the delaying for the predetermined time period in steps S14 to S18. Specifically, when the state of the image forming apparatus 10 before the input of the warm-up instruction is a state in which heating is stopped because the cover has been opened or a state in which heating is stopped because maintenance work is conducted, the control portion 8 conducts the delay for the predetermined time period in steps S14 to S18. First, the control portion 8 determines whether the heating-stopped time T before the input of the warm-up instruction is stored in the RAM 63 (S13). Here, when the heating-stopped time T exists in the RAM 63, the heating-stopped time T is read out from the RAM 63 in the next step S14. Then, the control portion 8 determines whether the heating-stopped time T is equal to or longer than a configured time period of 10 s (S15). The configured time period of 10 s is a time period required for decreasing the temperature of the fixing belt 75 to lower than 100° C. even when the temperature of the fixing belt 75 is controlled at the target temperature. In the present embodiment, as shown by an enclosure line 90A in FIG. 8, the temperature of the fixing belt 75 decreases to about 80° C. When the image forming apparatus 10 is driven at a low voltage, abnormality of the fixing belt 75 cannot be determined at a high temperature range in the enclosure line 89A. Thus, the control portion 8 proceeds to the next step 16 under a condition that the heating-stopped time T is equal to or longer than the configured time period of 10 s, and starts the temperature control of the heating roller 71 using the induction-heating unit 76. Thus, heating control (temperature control) of the fixing belt 75 starts.

Then, at step S17, after the temperature control of the heating roller 71 using the induction-heating unit 76 has started, the control portion 8 determines (temperature gradient determination) whether there is any abnormality based on the temperature change rate (change rate over time) of the temperature sensed using the temperature sensor 78. Specifically, a temperature change rate in accordance with the change in time is obtained based on the input signal from the temperature sensor 78, and a determination of the fixing belt 75 being abnormal is made when the temperature change rate is larger than a threshold determined in advance, whereas a determination of being normal is made when the temperature change rate is smaller than the threshold. The threshold is an element appropriately selected in accordance with the status of temperature change.

On the other hand, at step S15, when the heating-stopped time T is determined to be shorter than the configured time period of 10 s, the control portion 8 proceeds to the next step S19, and conducts a count-down of the predetermined time period. More specifically, the control portion 8 waits until the predetermined time period elapses. The predetermined time period is the remaining time that is short of the configured time period of 10 s, i.e., a time difference (=10−T [s]) between the configured time period of 10 [s] and the heating-stopped time T. When the remaining time elapses, the control portion 8 proceeds to step S16, starts the temperature control of the heating roller 71 using the induction-heating unit 76, and conducts the temperature gradient determination. Thus, under the condition that the heating-stopped time T is shorter than the configured time period of 10 s, the control portion 8 delays, for the predetermined time period, the timing to start the temperature control of the heating roller 71 using the induction-heating unit 76.

Furthermore, at step S13, when the heating-stopped time T does not exist in the RAM 63, the process proceeds to step S18, and the temperature sensed using the temperature sensor 78 is determined whether to be equal to or higher than 100° C. It should be noted that in the temperature control immediately after turning on of the main power supply of the image forming apparatus 10, the heating-stopped time T is not stored in the RAM 63. Thus, in such a situation, the control portion 8 proceeds to step S18.

At step S18, when the temperature sensed by the temperature sensor 78 is equal to or higher than 100° C., the control portion 8 conducts a count-down of the predetermined time period at the next step S19. More specifically, the control portion 8 waits until the predetermined time period elapses. The predetermined time period defined here is the same 10 [s] as the configured time period of 10 [s]. When the predetermined time period elapses, the temperature of the fixing belt 75 becomes lower than 100° C. Then, the control portion 8 proceeds to step S16, starts the temperature control of the heating roller 71 using the induction-heating unit 76, and conducts the temperature gradient determination. Thus, when the temperature sensed using the temperature sensor 78 is equal to or higher than 100° C., the control portion 8 delays, for the predetermined time period, the timing to start the temperature control of the heating roller 71 using the induction-heating unit 76. It should be noted that, at step S18, when the temperature sensed by the temperature sensor 78 is lower than 100° C., since the temperature of the fixing belt 75 is sufficiently low without waiting for the predetermined time period to elapse, the control portion 8 proceeds to step S16, starts the temperature control of the heating roller 71 using the induction-heating unit 76, and conducts the temperature gradient determination.

Since the image forming apparatus 10 according to the present embodiment is formed as described above, excessive heating of the heating roller 71 caused by abnormalities such as tear and upward-lifting of the fixing belt 75 can be prevented. In addition, when the heat generation (heating of the fixing belt 75) by the heating roller 71 using the induction-heating unit 76 is stopped in a state where the temperature of the fixing belt 75 is high, and the instruction to apply heat is inputted again; the timing, at which heat generation by the heating roller 71 using the induction-heating unit 76 is to be started, is delayed for the predetermined time period. When the heating roller 71 generates heat using the induction-heating unit 76 after the delay, from the change in temperature sensed by the temperature sensor 78 caused by the generation of heat, the temperature change rate in an normal state can be clearly distinguished from the temperature change rate in an abnormal state of the fixing belt 75, and abnormality determination using the temperature change rate can be conducted accurately and rapidly.

In the above described embodiments, although the image forming apparatus 10 including the fixing device 16 has been illustrated as an example, it is needless to say that the present invention is also applicable to a stand-alone product of the fixing device 16 by itself. In the above described embodiments, although an example in which the temperature sensor 78 is arranged near the center of the fixing roller 72 has been described, the temperature sensor 78 may be arranged not only near the center but also at both ends of the fixing roller 72.

The invention claimed is:

1. A fixing device comprising:

a magnetic flux generating unit;

a first rotary body configured to generate heat through action of magnetic flux generated by the magnetic flux generating unit;

a second rotary body disposed parallel with respect to the first rotary body;

a fixing belt extended on and extended between the first rotary body and the second rotary body, and is to be heated by the first rotary body;

a temperature sensing portion disposed in an upstream side from the second rotary body in a rotation direction of the fixing belt, but in a downstream side from the first rotary body in the rotation direction of the fixing belt, and capable of sensing temperature of the fixing belt; and a control portion configured to:

measure a time period during which heating has been stopped before a heating-start instruction for heating the fixing belt is inputted to the magnetic flux generating unit;

determine, after heating of the fixing belt is started, abnormality of the fixing belt based on a change rate over time of temperature sensed using the temperature sensing portion; and delay, for a predetermined time period, a timing at which heating of the fixing belt is to be started through generation of magnetic flux by the magnetic flux generating unit based on the heating-start instruction, under a condition that the measured time period during which heating has been stopped is shorter than a configured time period determined in advance and a temperature sensed by the temperature sensing portion is equal to or higher than a predetermined temperature.

2. The fixing device according to claim 1, wherein the predetermined time period is a time difference between the stopped time and the configured time period.

3. A fixing device according to claim 1, further comprising:

a magnetic flux generating unit;

a first rotary body configured to generate heat through action of magnetic flux generated by the magnetic flux generating unit;

a second rotary body disposed parallel with respect to the first rotary body;

a fixing belt extended on and extended between the first rotary body and the second rotary body, and is to be heated by the first rotary body;

a temperature sensing portion disposed in an upstream side from the second rotary body in a rotation direction of the fixing belt, but in a downstream side from the first rotary body in the rotation direction of the fixing belt, and capable of sensing temperature of the fixing belt; and a control portion configured to:

measure a time period during which heating has been stopped before a heating-start instruction for heating the fixing belt is inputted to the magnetic flux generating unit;

determine, after heating of the fixing belt is started, abnormality of the fixing belt based on a change rate over time of temperature sensed using the temperature sensing portion;

delay, for a predetermined time period, a timing at which heating of the fixing belt is to be started through generation of magnetic flux by the magnetic flux generating unit based on the heating-start instruction under a condition that the measured time period during which heating has been stopped is shorter than a configured time period determined in advance;

perform a first stop control of stopping the generation of magnetic flux by the magnetic flux generating unit, when a stop condition based an external factor against the fixing device is satisfied; and perform a second stopping control of stopping heating of the fixing belt through the generation of magnetic flux by the magnetic flux generating unit, when at least the generation of magnetic flux by the magnetic flux generating unit is temporarily stopped and a mode is switched to a power saving mode for reducing an amount of power consumption required for heating the fixing belt, wherein the control portion delays the timing at which heating is to be started after the stop by the first stop control but does not delay the timing at which heating is to be started after the stop by the second stop control.

4. An image forming apparatus comprising the fixing device according to claim 1.

* * * * *